US011491388B2

(12) United States Patent
Soldan

(10) Patent No.: US 11,491,388 B2
(45) Date of Patent: Nov. 8, 2022

(54) BINDING TOE-PIECE FOR GLIDING BOARD

(71) Applicant: SALOMON S.A.S., Epagny Metz-Tessy (FR)

(72) Inventor: Daniel Soldan, Gruffy (FR)

(73) Assignee: SALOMON S.A.S., Epagny Metz-Tessy (FR)

( * ) Notice: Subject to any disclaimer, the term of this patent is extended or adjusted under 35 U.S.C. 154(b) by 0 days.

(21) Appl. No.: 17/186,134

(22) Filed: Feb. 26, 2021

(65) Prior Publication Data

US 2021/0268365 A1 Sep. 2, 2021

(30) Foreign Application Priority Data

Feb. 27, 2020 (FR) ..... 2001947

(51) Int. Cl.
*A63C 9/10* (2012.01)

(52) U.S. Cl.
CPC ..... *A63C 9/10* (2013.01)

(58) Field of Classification Search
CPC ..... A63C 9/0805; A63C 9/22; A63C 9/0844; A63C 9/08564; A63C 9/08585; A63C 9/10
See application file for complete search history.

(56) References Cited

U.S. PATENT DOCUMENTS 3,727,935 A * 4/1973 Unger ..... A63C 9/08 280/626
4,226,439 A * 10/1980 Kirsch ..... A63C 9/001 280/627

(Continued)

FOREIGN PATENT DOCUMENTS

DE 3122653 A * 12/1982 ..... A63C 9/0844
DE 102012214002 A1 * 2/2014 ..... A63C 9/0844

(Continued)

OTHER PUBLICATIONS

French Search Report issued in French Patent Application No. 2001947, dated Nov. 11, 2020, and an English language translation of the Written Opinion thereof.

*Primary Examiner* — James A Shriver, II
*Assistant Examiner* — Michael T. Walsh
(74) *Attorney, Agent, or Firm* — Greenblum & Bernstein, P.L.C.

(57) ABSTRACT

Toe-piece for a boot on a gliding board including a chassis affixed to the gliding board; a body movable on the chassis; a sole-clamp movable on the body; a lateral release mechanism including a first elastic mechanism to return the sole clamp to engagement with the boot; a vertical retention mechanism having a second elastic mechanism arranged to continuously exert a return force on the body to bring the sole-clamp toward the lower surface of the chassis, the return force pressing the sole-clamp on the boot; at least one cam kinematically inserted between the second elastic mechanism and either the chassis or the body, the cam being shaped to modify, in relation to the chassis, the direction of the return force exerted by the second elastic mechanism on the body to attenuate a variation in the pressing force when the sole-clamp is away from the lower surface of the chassis.

17 Claims, 12 Drawing Sheets

(56) References Cited

U.S. PATENT DOCUMENTS

| | | | | | |
|---|---|---|---|---|---|
| 4,298,213 | A * | 11/1981 | Storandt | A63C 9/08564 | 280/628 |
| 4,765,641 | A * | 8/1988 | Peyre | A63C 9/0855 | 280/634 |
| 5,879,020 | A * | 3/1999 | Buquet | A63C 9/0842 | 280/634 |
| 5,913,532 | A * | 6/1999 | Viodet | A63C 9/005 | 280/633 |
| 6,585,283 | B2 * | 7/2003 | Merino | A63C 9/08564 | 280/634 |

FOREIGN PATENT DOCUMENTS

| | | | | | |
|---|---|---|---|---|---|
| DE | 202018106501 | U1 * | 3/2019 | A63C 9/0807 | |
| EP | 0241360 | A1 * | 2/1987 | A63C 9/085 | |
| EP | 0241360 | A1 * | 10/1987 | | |
| EP | 1151765 | A1 * | 11/2001 | A63C 9/08521 | |
| EP | 2174695 | A1 * | 4/2010 | A63C 9/08521 | |
| EP | 2300111 | B1 * | 1/2018 | A63C 7/12 | |
| IT | 1240915 | B * | 12/1993 | | |
| WO | WO-02055161 | A1 * | 7/2002 | A63C 9/0844 | |

* cited by examiner

BINDING TOE-PIECE FOR GLIDING BOARD

CROSS-REFERENCE TO RELATED APPLICATION

This application is based upon French Patent Application No. FR 20 01947, filed Feb. 27, 2020, the disclosure of which is hereby incorporated by reference thereto in its entirety, and the priority of which is claimed under 35 U.S.C. § 119.

BACKGROUND

1. Field of the Invention

The present invention relates to the field of boot bindings on a gliding board. The invention relates more particularly to a binding toe-piece, as well as a binding or a gliding board equipped with such a toe-piece. The invention has a particularly advantageous application in the field of skiing.

2. Background Information

A boot binding on a gliding board, such as a ski or a snowboard, generally comprises a front retaining device, referred to as a toe-piece, and a rear retaining device, referred to as a heel-piece. The boot is inserted between the tope piece and the heel-piece, these elements being attached to the gliding board. The toe-piece and the heel-piece are each equipped with stopping means acting on the boot so as to block the displacement of the boot in relation to the gliding board along the three longitudinal, vertical, and transverse directions. Thus, the combined action of these two retaining devices makes it possible to affix the boot to the gliding board, when the boot is engaged with the binding.

Various solutions exist for making a toe-piece or a heel-piece. For example, patent documents EP-A-0 241 360, EP-A-1 151 765, and EP-A-2 174 695 describe various embodiments of toe-pieces and heel-pieces. In these illustrations, the toe-piece incorporates a sole-clamp comprising two V-shaped wings, the branches of which partially cover a front extension of the boot, along a vertical direction. Furthermore, the sole of the boot, i.e., the lower surface of the boot, presses on a support plate fixed to the gliding board. Consequently, the vertical immobilization of the boot in the area of the toe-piece is achieved by a double contact between the upper surface of the front extension of the boot and the wings of the toe-piece, on the one hand, and the sole of the boot and the support plate, on the other hand.

For safety reasons, the toe-piece and the heel-piece typically incorporate a safety mechanism making it possible to release the binding, if necessary. This mechanism enables the foot of the user to be freed to avoid injury during accidental transverse and/or vertical movement of the foot. This may occur in the event of a fall or other circumstances to prevent injury to the foot when the forces exerted on the boot exceed predetermined values. Safety mechanisms for the toe-piece are also described in the above-cited documents.

Various types of ski boots exist, including boots for alpine skiing and boots for ski touring. These two categories of boots are characterized by the NF ISO 5355 and NF ISO 9523 standards, respectively, and distinguish over one another by the dimensions of the portions interfacing with the elements of the binding. The dimensions of the interfacing portions vary from one category to the other and, therefore, the bindings are generally designed or configurable to receive a single boot category.

Certain toe-pieces comprise a mechanism allowing for elastic adjustment of the height, or vertical positioning, of their wings. This elastic mechanism is used to compensate for small dimensional variations due to the manufacturing tolerances in a boot of the same category. However, these toe-pieces do not allow sufficient height adjustment to make the binding compatible with alpine ski boots and ski touring boots automatically (without adjustment by the user).

Similarly, there are bindings in which the support plate interfacing with the sole of the boot is mounted on an elastic mechanism in order to compensate for the dimensional variations inherent in a particular boot category. These toe-pieces also do not allow making the binding compatible with alpine ski boots and ski touring boots automatically (without adjustment by the user).

Other toe-pieces are divided into two portions, the portion incorporating the wings being adjustable in height, via an adjustment screw, in relation to the other portion fixed to the ski. A toe-piece of this type enables the binding to be configured alternately for alpine ski boots and for ski touring boots. However, a toe-piece of this type is complex, expensive, and hardly compatible with a mechanism making it possible to compensate for the dimensional variations inherent in a boot category. This design does not make it possible to cover large dimensional variations. Furthermore, the height adjustment of the wings for compatibility with a hoot category is not straightforward, because the adjustment is carried out continuously and without reference markings, by screwing the screw. It is therefore not easy to adjust the height of the wings correctly for a particular boot category. Moreover, this type of adjustment to adapt to a boot category is not convenient for the user as it requires moving the portion incorporating the wings over a long length of travel, which involves turning the screwdriver several times.

Alternatively, other toe-pieces, also comprised of two portions, make it possible to modify the vertical position of the support plate in relation to the portion incorporating the wings. The disadvantages are similar to those of the previous constructions, in which it is the portion incorporating the wings that is movable.

For these two-portion toe-pieces, the adjustment is generally done with the boots and often requires a plurality of operations to adjust the tightening.

SUMMARY

Therefore, the present invention provides a user-friendly and reliable solution for automatically making the binding compatible with boots having various dimensions with respect to their interface with the binding, without adjustment by the user.

The present invention also provides a user-friendly and reliable solution for enabling alpine ski boots and ski touring boots to be used on the same binding.

The invention further provides a binding that is automatically compatible with a plurality of boot categories without significantly disrupting the operation of the lateral release mechanism.

The other objects, characteristics and advantages of the present invention will become apparent from the following description and the annexed drawings. It is to be understood that other advantages can be incorporated.

To achieve these objects, according to one embodiment, a retaining device, for example a toe-piece, is provided for binding a boot on a gliding board, comprising:

- a chassis having an interface, typically a lower surface, configured to be affixed to the gliding board;
- a body movably mounted on the chassis;
- a sole-clamp movably mounted on the body and capable of coming into contact with an upper surface and at least one lateral portion of a front or rear portion of the boot, when the boot is engaged with the binding;
- a lateral release mechanism comprising at least one first elastic mechanism acting on the sole-clamp to return it back to a configuration of engagement with the boot;
- a vertical retention mechanism comprising a second elastic mechanism, distinct from the first elastic mechanism, arranged so as to continuously, or always, exert a return force on the body in order to bring the sole-clamp back toward the lower surface of the chassis, this return force producing a force pressing the sole-clamp on the boot, when the boot is engaged with the binding.

The toe-piece comprises at least one cam, kinematically interposed between the second elastic mechanism and either the chassis or the body. The cam is shaped to modify the direction of the return force exerted by the second elastic mechanism on the body, as a function of the position of the body in relation to the chassis, so as to attenuate a variation in the pressing force when the sole-clamp is away from the interface of the chassis.

Due to this construction, the pressing force exerted by the sole-clamp on the boot remains controlled regardless of the dimensions of the portion of the boot interfacing with the binding. For example, if an interface having a greater thickness, taken along a vertical direction, is used, as is the case for ski touring boots, the cam makes it possible to control the pressing force and to reduce the frictional forces between the sole-clamp and the boot during lateral release, thereby improving the reliability of the lateral release. Thus, the invention makes it possible to significantly improves the safety of the user of a self-configuring binding.

Boots having variable dimensions for interfacing with the binding can then be used with a binding equipped with this toe-piece. Typically, the present invention enables both alpine ski boots and ski touring boots to be used with the same binding, these two categories distinguishing over one another in particular by the dimensions of the portions interfacing with the toe-piece; these portions are referred to as the sole below for the sake of brevity. Irrespective of the type of boot used, the lateral release force remains controlled.

For a toe-piece of this type, in which the displacement of the sole-clamp is energized, the distancing of the sole-clamp in relation to the gliding board causes an increase in the compression of the second elastic mechanism, and thus causes an increase in the return force generated by this second elastic mechanism. In the absence of the cam, this increase in the return force would result in a very significant increase in the pressing force exerted by the sole-clamp on the boot. This pressing force would generate friction between the sole-clamp and the boot. This friction would oppose the movability of the sole-clamp in relation to the body, and thus would oppose the lateral release and, ultimately, the release of the boot. Therefore, the release of the boot would not be controlled, and the safety of the user would be substantially degraded, in a configuration in which the sole-clamp would be away from the gliding board.

The claimed construction adds a cam that tends to reduce the increase in the pressing force when the sole-clamp is moved away from the gliding board. In other words, this makes it possible, for example, to have a small variation in the pressing force, or at least a controlled variation, irrespective of the position of the sole-clamp.

Depending on the configuration of the toe-piece, and in particular the shape of the cam and the dimensioning of the second elastic mechanism, the pressing force can be provided to remain constant regardless of the position of the sole-clamp in relation to the gliding board. Thus, regardless of the type of boots used, it is possible to obtain a lateral release force that remains substantially constant.

Optionally, the toe-piece can further have at least any of the following characteristics, which can be taken separately or in combination.

According to one example, the body is pivotally mounted on the chassis about an axis of rotation that is crosswise to a longitudinal axis of the chassis, the cam being dimensioned so as to modify the direction of the return force exerted by the second elastic mechanism on the body, so that the distance between the direction of the return force and the axis of rotation of the body differs as a function of the angle of inclination of the body in relation to the chassis. The inclination of the body in relation to the chassis is measured in a vertical plane passing through the longitudinal axis of the chassis.

According to one example, the axis of rotation of the body is positioned in the area of the upper portion of the body, above the first elastic mechanism of the lateral release mechanism.

According to one example, the cam and the vertical retention mechanism are shaped such that the pressing force Fp does not vary by more than 20%, preferably does not vary by more than 10%, irrespective of the position of the sole-clamp in relation to the body. This makes it possible to avoid a substantial increase in the intensity of the lateral release force that must be exerted on the sole-clamp, i.e., the threshold value enabling the toe-piece to switch to the release configuration in order to release the boot.

According to one example, the second elastic mechanism is arranged so as to act continuously, or always, on the body, irrespective of the position of the sole-clamp in relation to the body.

According to one example, the sole-clamp exerts on the first elastic mechanism of the lateral release mechanism an action that is opposite that exerted by the first elastic mechanism on the sole-clamp. The second elastic mechanism is arranged so as to act on the body independently of the action of the sole-clamp on the first elastic mechanism of the lateral release mechanism. The displacement of the sole-clamp in relation to the body does not act on the second elastic mechanism. Thus, the first elastic mechanism and second elastic mechanism operate independently.

According to one example, the first elastic mechanism is configured to be alternately compressed and relaxed along a first working axis, the second elastic mechanism is configured to be alternately compressed and relaxed along a second working axis, the second working axis being misaligned with respect to the first working axis. According to an example of embodiment, the first and second working axes are contained in the same vertical plane. However, they are not parallel.

According to one example, the second elastic mechanism acts directly on a piston capable of translating into a housing of the body, a portion of the piston forming a first profile of the cam.

According to one example, the sole-clamp comprises two wings, each wing being pivotally mounted on the body. In one example, each wing pivots independently of the other wing on the body.

According to one example, the cam is dimensioned such that the return torque exerted on the body, and characterized by the product of the intensity of the return force multiplied by the distance between the direction of the return force and the axis of rotation of the body, is, when the sole-clamp is away from the gliding board, identical, at approximately 20%, preferably at approximately 10% to this return torque when the sole-clamp is close to the lower surface of the chassis.

According to one example, the lateral release mechanism comprises an adjustment device configured to adjust a threshold value of a release force to be applied by the boot to the lateral release mechanism in order to cause the sole-clamp to switch from an engagement configuration to a release configuration. According to one example, the toe-piece also comprises a compensation mechanism configured to exert an additional return force on the body, the intensity of the additional return force being a function of such adjustment. The pressing force is then a function of the return force exerted by the second elastic mechanism and of the additional return force exerted by the compensation mechanism. According to one example, the compensation mechanism is configured to increase the pressing force when the adjustment increases the threshold value of the release force. Thus, if the user wishes to be more firmly supported laterally, he will adjust the adjustment device in that direction. As a result, the sole-clamp pressing force on the boot will also increase automatically. This further improves the safety provided by the toe-piece. Thus, the proposed toe-piece makes it possible to:

- maintain a constant pressing force, regardless of the boot used, when the user wishes to preserve the adjustment of the threshold value of the release force; and
- vary this pressing force as a function of the release threshold value adjusted by the user, typically by increasing the pressing force, when the user increases the lateral release threshold value.

According to one example, the second elastic mechanism is carried by the body. According to one example, the cam has a first cam profile affixed to the body in rotation about the axis of rotation, and a second cam profile affixed to the chassis. According to one example, the first cam profile is translationally mounted on the body. According to an alternative example, the second elastic mechanism is carried by the chassis. According to one example, the cam has a first cam profile affixed to the body in rotation about the axis of rotation, and a second cam profile carried by the chassis and preferably being slidably mounted on the chassis.

Another aspect relates to a boot binding on a gliding board, comprising a retaining device as described above and a complementary retaining device, the retaining device being either a toe-piece or a heel-piece and the complementary retaining device also being either a toe-piece or a heel-piece, respectively.

Another aspect relates to a gliding board equipped with at least one toe-piece according to the preceding paragraphs.

BRIEF DESCRIPTION OF DRAWINGS

The objects, characteristics, and advantages of the invention will be better understood from the detailed description that follows, with reference to the annexed drawings illustrating, by way of non-limiting embodiments, how the invention can be carried out, and in which.

Figure 1:
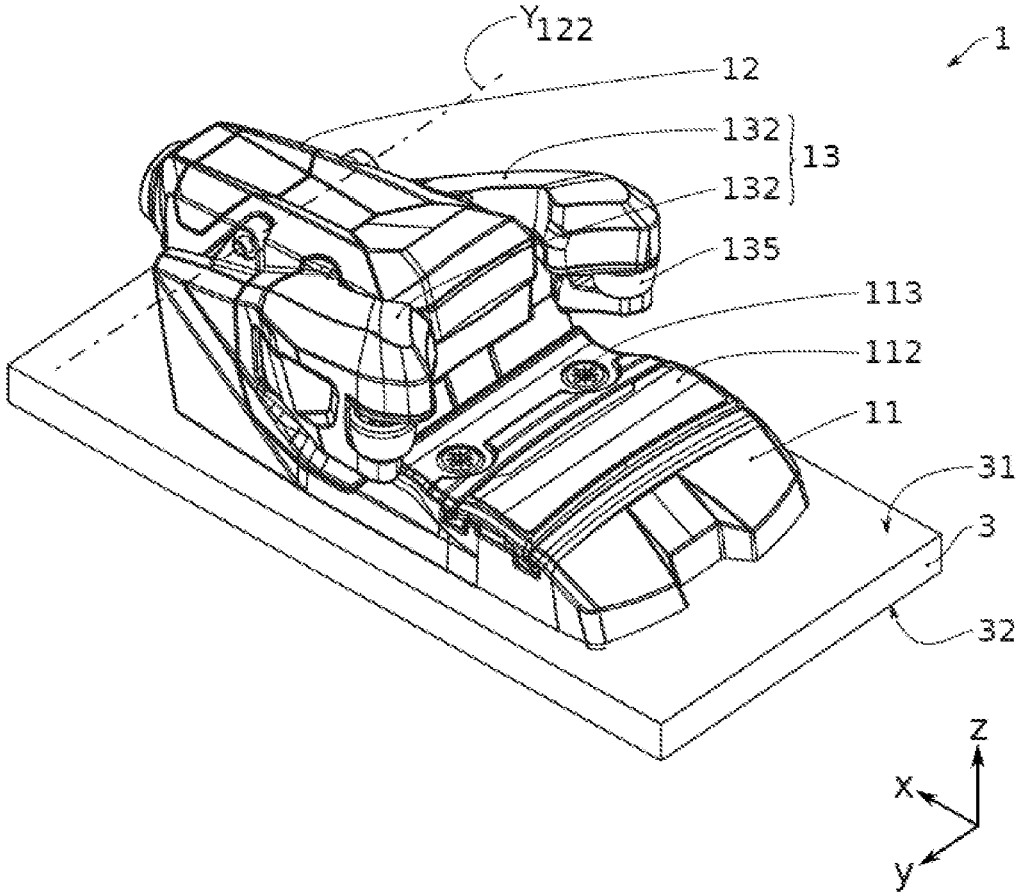
FIG. 1 is a perspective view of a toe-piece according to an example embodiment of the present invention and of a portion of a gliding board equipped with such a toe-piece.
Figure 2:
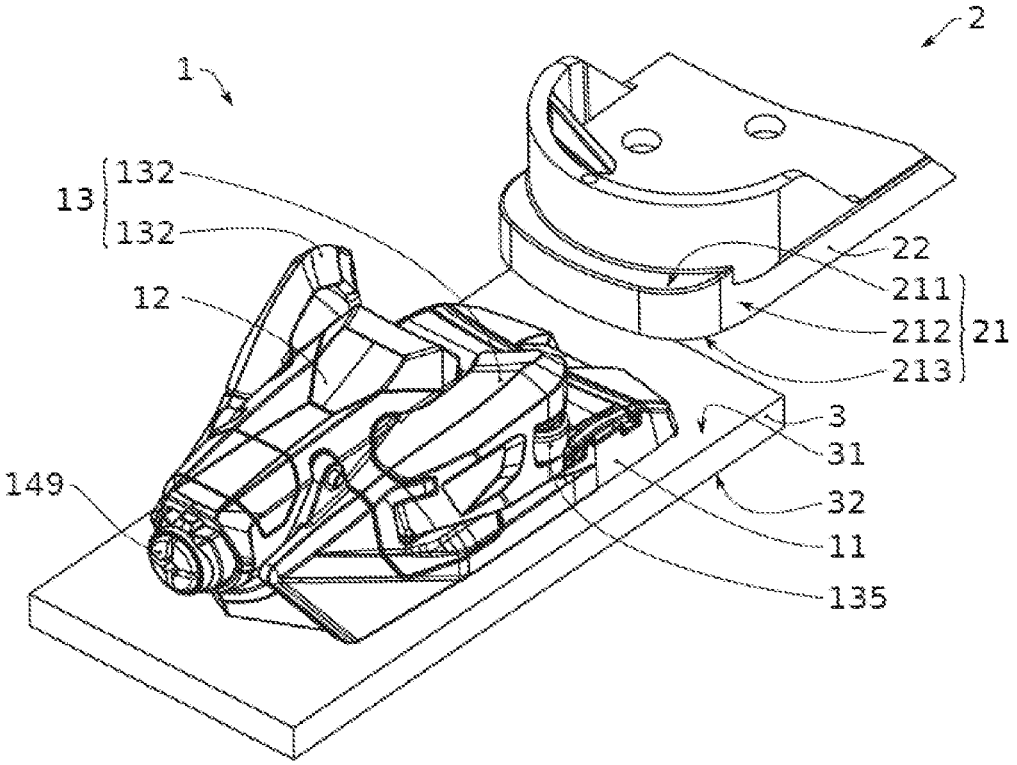
FIG. 2 is another perspective view of the toe-piece shown in FIG. 1 and of a portion of a boot.

The drawings are given as examples and are not limiting to the invention. They constitute schematic representations intended to facilitate the understanding of the invention and are not necessarily at scale for practical applications.

DETAILED DESCRIPTION

The following detailed description makes use of terms such as "horizontal", "vertical", "longitudinal", "transverse", "upper", "lower", "top", "bottom", "front", "rear", "interior", "exterior". These terms should be considered as relative terms in relation to the normal position of the binding/boot/gliding board assembly, and to the normal direction of forward displacement of the user of the assembly. For example, the terms "horizontal" and "longitudinal" correspond to the main direction of extension of the gliding board. The surface of the gliding board intended to receive the binding is oriented toward the "top" and the surface of the gliding board intended to rest on the snow is oriented toward the "bottom". For illustrative and non-limiting purposes, reference may be made below to a ski as the gliding board or to a skier as the user.

A reference point will also be used, of which the longitudinal or rear/front direction corresponds to the X axis, the transverse or right/left direction corresponds to the Y axis, and the vertical or down/up direction corresponds to the Z axis.

Furthermore, the term "engagement" refers to the affixation of the boot to the binding, and the term "release" refers to the separation of the boot from the binding. More precisely, the "lateral release" corresponds to the release of the binding by a lateral force of the boot on the binding. In the embodiments described below, the lateral release is achieved in the area of the toe-piece, by a lateral displacement of the front of the boot. Typically, this lateral displacement is caused by the user's fall. An engagement configuration corresponds to a configuration for which the boot is engaged with the binding.

By "release level" of the binding is meant a measurement of the value of the force to be exerted by the boot on an element of the binding in order to release the boot from the binding via the release mechanism. This value may be marked on the binding in accordance with the ISO 9462 standard or one of its subsequent editions. It may correspond to an adjustment value or to a pre-adjustment value of the associated binding. For the release level to be efficient, the spacing of the binding elements must be adapted to the boot intended to be engaged with the binding, in order to ensure proper engagement of the binding.

The terms "DIN adjustment" or "DIN value", with respect to the release, refer to the adjustment or the value that is set by a German Institute for Standardization (DIN stands for "Deutsches Institut für Normung"). A DIN-certified binding thus meets certain standards. In particular, all DIN-certified bindings have equivalent adjustments. In particular, the release level of a binding of one brand adjusted to a DIN value equal to 6 will be the same as that of a binding of another brand adjusted to the same DIN value if both bindings are DIN-certified.

In the following the description, the term "on" does not necessarily mean "directly on". Thus, when a part or a member A is said to take support "on" a part or a member B, this does not mean that the parts or members A and B are necessarily in direct contact with one another. These parts or members A and B can either be in direct contact with or take support on one another through one or more other parts. The same is true for other expressions such as the expression "A acts on B", for example, which may mean that "A acts directly on B", or that "A acts on B through one or more other parts."

In the context of the instant description, the expression "kinematically inserted between" does not necessarily mean in "contact with". Thus, if a part A is kinematically inserted between a part B and a part C, this does not mean that A and B are necessarily in direct contact, or that A and C are necessarily in direct contact. This means that a movement or a force of the part B or of the part C, respectively, can be at least partially transmitted to the part C or to the part B, respectively, through the part A.

In the instant description, the term "movable" corresponds to a rotational movement or a translational movement or even a combination of movements, for example the combination of a rotation and a translation.

In the instant description, the term "to attenuate" is equivalent to the term "to reduce". It can mean to reduce partially or completely, i.e., to cancel.

In the instant description, when two parts are said to be distinct, it means that these parts are separate. They are:

- positioned at a distance from one another, and/or
- movable in relation to one another, and/or
- affixed to one another through attached elements; this affixation may or may not be removable.

A unitary part cannot therefore be comprised of two distinct parts.

In the instant description, the term "affixed" used to qualify the connection between two parts means that the two parts are connected/fixed in relation to one another, according to all degrees of freedom, at least for a configuration of use, unless it is explicitly specified otherwise. For example, if two parts are said to be translationally affixed to one another along an X direction, this means that the parts can be movable, possibly according to several degrees of freedom, to the exclusion of the freedom in translation along the X direction. In other words, if one part is displaced along the X direction, the other part performs the same displacement.

In the instant description, an elastic mechanism can be considered to be an object that has the ability to deform under applied force and then use such force to return to its original shape. Conversely, an object that can return to its original shape after being deformed by applied force, can be considered an elastic mechanism. An elastic mechanism can be a spring, for example, such as but not limited to, a coil spring, an elastic washer such as a Belleville washer, elastomer, rubber, etc.

In the instant description, the term "cam device" corresponds to a device comprising at least:

- a first so-called guide surface, also referred to as a cam profile, carried by a first part, and
- a second surface carried by a second part.

Either one of the first and second parts is movable, at least in rotation in relation to a chassis about an axis of rotation. The first and second surfaces are configured such that, when the movable part is rotationally driven in relation to the chassis, the projected distance (D1, D2) between the axis of rotation (Y122) and the normal direction (Fr1, Fr2) at the point of contact between these two surfaces varies.

A non-limiting example of a toe-piece according to the present invention will now be described in detail with reference to FIGS. 1 to 9.

As indicated in the Background Information section related to the state of the art, a binding usually comprises two retaining devices, including a toe-piece and a heel-piece, for retaining a boot on a gliding board. In the non-limiting example, which will be described below, the retaining device considered is a toe-piece. Alternatively, or in combination, the invention can also be applied to a heel-piece.

The toe-piece 1 comprises a chassis 11, a body 12, and a sole-clamp 13. These elements will be described in detail below.

Chassis 11

The chassis 11 has a lower surface 111 intended to be positioned opposite an upper surface 31 of a gliding board 3. The gliding board also has a lower surface 32 intended to be in contact with a substrate such as snow. The lower surface 111 of the chassis 11 can be fixed to the upper surface 31 of the gliding board 3 by being either directly in contact with the latter, or by being fixed to the gliding hoard 3 by means of another element.

This fixing can eliminate any degree of freedom between the chassis 11 and the gliding board 3. To this end, and as is visible in FIGS. 1, 3, and 4, the chassis 11 comprises fixing devices, typically screws 113, that engage with a thread formed in the gliding board 3.

According to an alternative example, this fixing of the chassis 11 to the gliding board 3 can be provided to allow at least one degree of freedom, for example in translation of the chassis 11 in relation to the gliding board 3. According to this alternative example, the chassis 11 can then be provided to be mounted on a rack sliding along a longitudinal axis of the gliding board 3. This allows adjustment of its longitudinal position. Once the toe-piece is positioned longitudinally, the chassis is blocked from further displacement in all directions. The chassis is then affixed to the gliding board according to all the degrees of freedom in this configuration of use.

The chassis 11 also carries a support plate 112, an upper surface of which is intended to come into contact with a portion of a boot 2. In the example illustrated, the support plate 112 is configured to receive a front portion 21 of a boot 2. More precisely, the lower surface 213 of a sole 22 of the boot 2 takes support on the upper surface of this support plate 112.

In this example, the chassis 11 is defined by a median longitudinal axis X115 extending along a direction parallel to the X axis. The longitudinal axis X115 of the chassis corresponds to the longitudinal axis of the toe-piece. The longitudinal axis X115 of the chassis, the longitudinal axis of the gliding board 3 and the X axis are substantially parallel.

Body 12

The body 12 of the toe-piece 1 is movably mounted on the chassis 11 and carries the sole-clamp 13. In the example illustrated, this movability is a rotational movability. Alternatively, a translational movability or a movability combining rotational and translational movements can be provided.

In the example illustrated, the body 12 is rotationally mounted about an axis of rotation Y122 transverse to the longitudinal axis X115 of the chassis 11. These axes X115, X122 are referenced in particular in FIG. 6. They are parallel to the X axis and to the Y axis, respectively, of the orthogonal reference point XYZ illustrated in FIGS. 5 and 6. Thus, the body 12 can tilt in relation to the chassis 11 and, consequently, in relation to the gliding board 3, along an angle $\alpha$ that can be measured between the longitudinal axis X115 of the chassis 11 and a median longitudinal axis X121 of the body 12. The median axis X121 of the body 12 is contained in a plane parallel or identical to the plane ZX, and the angle $\alpha$ is measured in this same plane passing through the median axis X121 of the body 12. The inclination of the body in relation to the chassis is therefore measured in a vertical plane passing through the longitudinal axis of the chassis. According to a non-limiting example, the longitudinal axis X115 of the chassis 11 and the median axis X121 of the body 12 are included in the same plane, preferably the same vertical plane, preferably the plane ZX.

Figure 7:
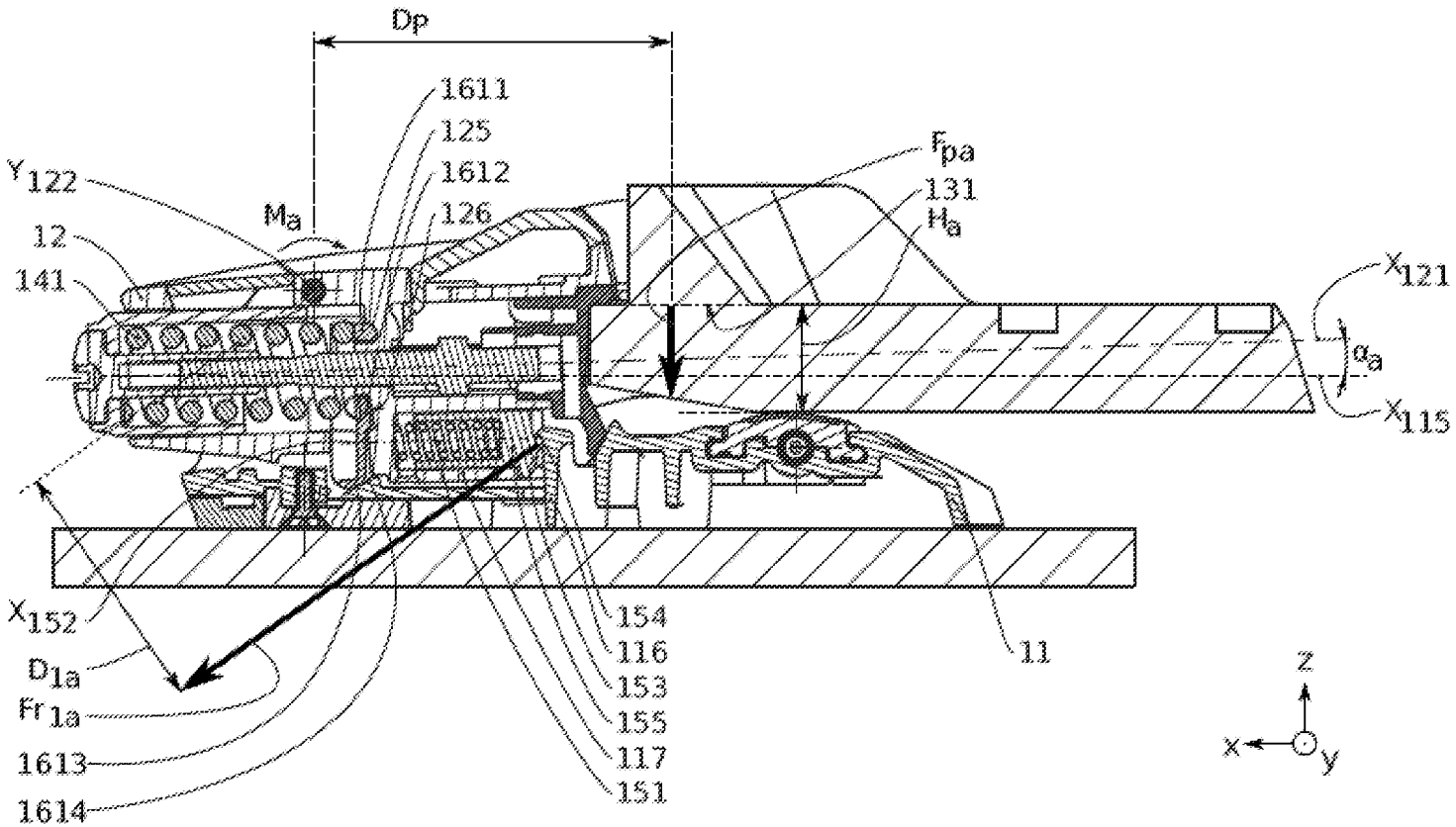
FIG. 7 corresponds to FIG. 6, a portion of a first boot category being shown in engagement with the toe-piece.
Figure 8:
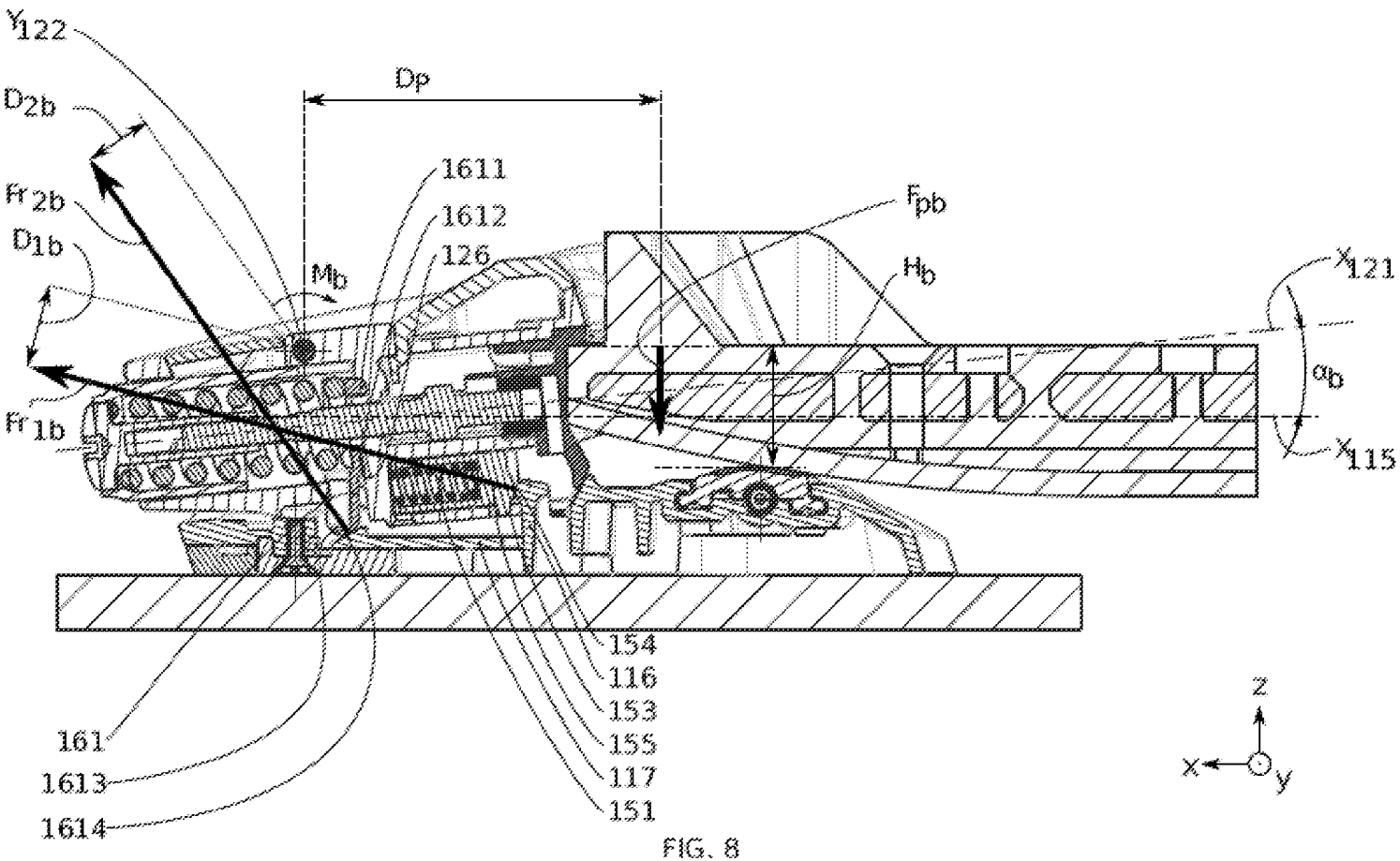
FIG. 8 corresponds to FIG. 6, a portion of a second hoot category, different from the first boot category, being shown in engagement with the toe-piece.

In FIG. 7, the longitudinal axis X115 of the chassis 11 is parallel to, or even merged with, the median axis X121 of the body 12. The angle $\alpha$ is then zero. In FIGS. 7 and 8, the median axis X121 of the body is inclined by an angle $\alpha$ (referenced as aa in FIG. 7 and ab in FIG. 8) in relation to the longitudinal axis X115 of the chassis 11. This angle $\alpha$ increases when the body 12, in the area of the sole-clamp 13, moves away from the board 3.

The chassis comprises a yoke having two flanges 114 carrying a shaft 1221 materializing the axis of rotation Y122. The shaft 1221 can be fixed in relation to the yoke of the chassis 11, the body 12 then rotating about this shaft 1221. Alternatively, the shaft 1221 can be provided to be fixed in relation to the body 12 and rotationally mounted in the yoke.

Figure 6:
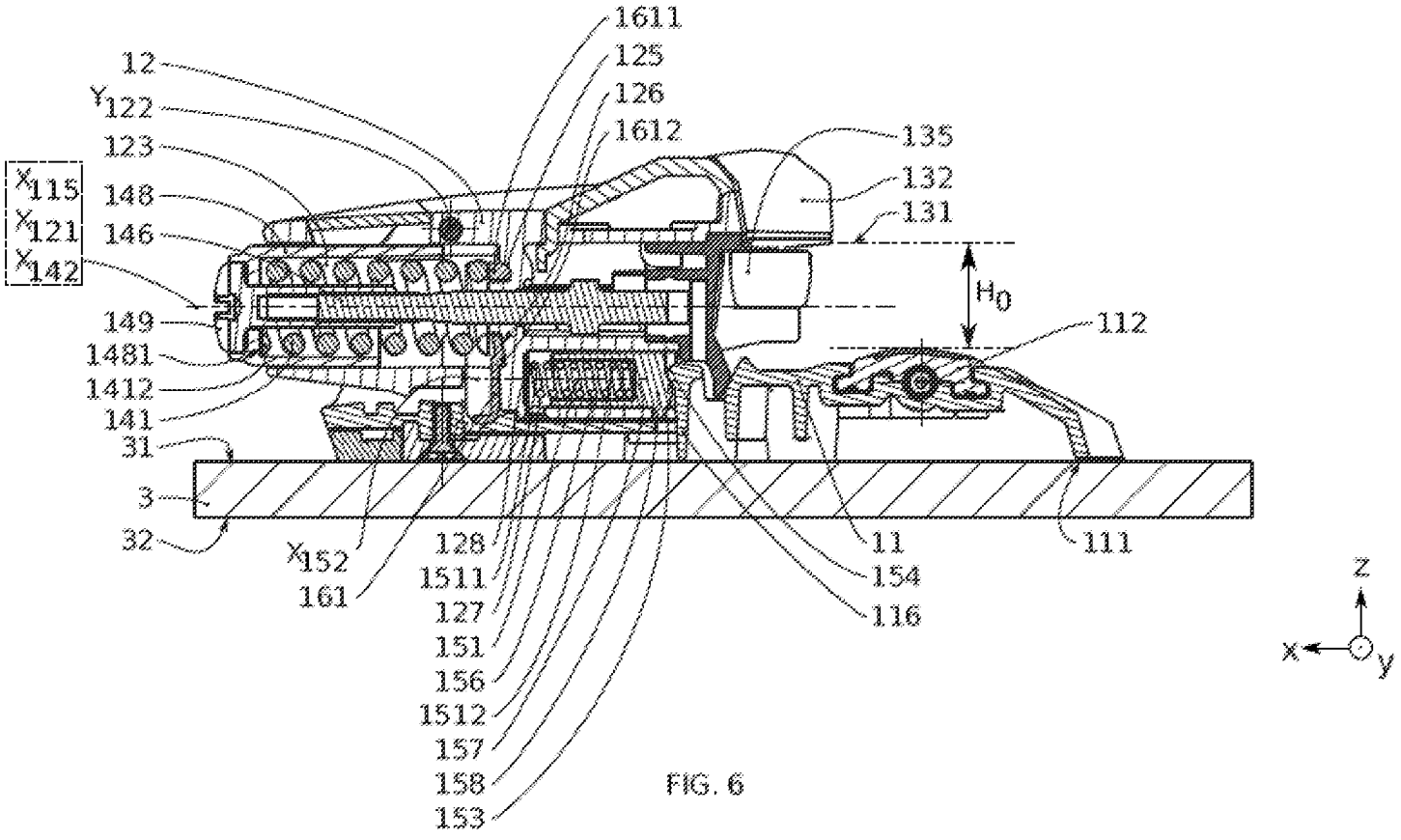
FIG. 6 is a view of the toe-piece illustrated in FIG. 1, in vertical cross-section and passing through a median axis of the toe-piece. The toe-piece is shown in the lower position, that is to say in a position in which it is not biased by a boot.

In this example, as seen in FIGS. 6 to 8, the axis of rotation Y122 of the body 12 is positioned in the area of the upper portion of the body. The yoke thus enables such positioning of the axis of rotation, at a certain height of the upper surface 31 of the gliding board 3. The body 12 can thus pivot mainly below this axis of rotation Y122.

Sole Clamp 13

The toe-piece 1 comprises a sole-clamp 13. As indicated above in the Background Information section related to the state of the art, the sole-clamp 13 has for a function to maintain a portion of the boot 2 affixed to the gliding board 3, at least along the vertical and transverse directions. To this end, the sole-clamp exerts a pressing force Fp on the portion of the boot 2 in order to maintain it in contact with the support plate 112. This pressing force Fp is vertical or has a vertical component.

In this example, the sole-clamp 13 has a lower support surface 131 and rollers 135 configured to come into contact with the boot 2. When the retaining 1 is a toe-piece, the boot portion 2 on which the sole-clamp 13 exerts a pressing force is a front portion. Preferably, the sole-clamp 13 is configured so that the lower support surface 131 comes into contact with an upper surface 211 of the front portion 21 of the boot 2. Preferably, the sole-clamp is also configured so that each roller 135, and more precisely a portion of the outer cylindrical surface of a roller 135, comes into contact with a lateral surface 212 of this front portion 21 of the boot 2. In the example illustrated in FIG. 2, for example, the front portion 21 of the boot 2 is an integral part of, or at least partially formed by, a sole 22 of the boot 2. Alternatively, the front portion of the boot can be a portion of a separate insert attached to the boot.

According to another variant, the sole-clamp acts on a portion of the boot 2 which is distinct from the sole 22 of the boot 2. The term sole-clamp 13 therefore does not necessarily imply a contact of the sole-clamp 13 in the area of a sole of the boot 2. Indeed, the portion of the boot 2 on which the sole-clamp 13 can exert the pressing force Fp may be a portion of the boot located above the sole 22.

Figure 5:
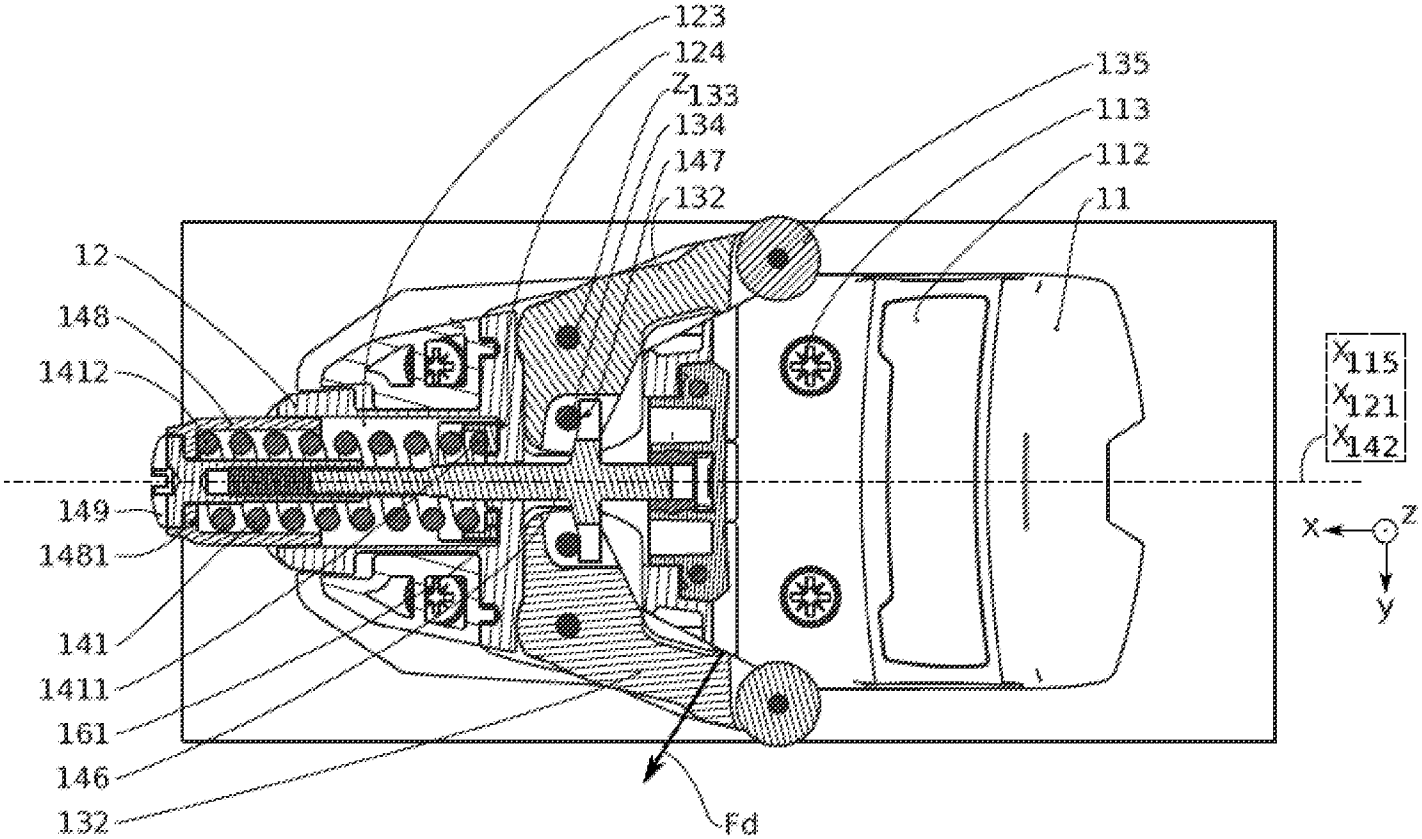
FIG. 5 is a horizontal cross-sectional view of the toe-piece illustrated in FIG. 1.

In the example shown, the sole-clamp 13 of the toe-piece comprises two wings 132 arranged on both sides of the median axis X121 of the body 12. As shown in FIG. 5, each wing 132 carries a roller 135 intended to come into contact with a lateral surface 212 of the front portion of the boot. Each wing 132 is rotationally mounted on the body 12 about an axis of rotation Z133. This axis of rotation Z133 is substantially vertical, in particular when the median axis X121 of the body 12 is aligned with the longitudinal axis X115 of the chassis 11. Naturally, this axis of rotation Z133 tilts with respect to the chassis 11 and therefore with respect to the vertical when the body 12 pivots about the axis Y122.

In an engagement configuration of the boot 2, each wing 132 of the sole-clamp 13 exerts a pressing force Fp on the boot 2, via the lower support surface 131. This pressing force Fp tends to constrain the boot 2 between the wing 132 and the support plate 112.

In a variant, the sole-clamp 13 is a unitary part having two arms, each arm being intended to cover an upper surface and a lateral surface of an edge of the front portion of the boot. The sole-clamp is also rotationally mounted on the body 12 about an axis of rotation Z, substantially perpendicular to the median axis X121 of the body 12.

Lateral Release Mechanism

The body 12 also comprises a lateral release mechanism configured to:

- retain or return each wing 132 into an engagement configuration with the boot 2,
- allow the rotation of each wing 132 about its axis of rotation Z133 in order to switch to the release configuration when the force Fd exerted by the boot 2 on the binding is sufficient. This force, referred to as the release force, is referenced as Fd in FIG. 5.

More specifically, the release force Fd exerted by the boot 2 on the sole-clamp 13 has at least one component perpendicular to the axis of rotation Z133 of the wing 132. When this component is sufficient, at least one of the wings 132 rotates about its axis of rotation Z133. This enables a displacement of the front portion of the boot 2 in relation to the chassis 11 along a substantially lateral direction, that is to say along a direction having a horizontal component (Y axis) perpendicular to the longitudinal axis X115 of the chassis 11. In the release configuration, the wing 132 is no longer in engagement with the front portion of the boot 2. The boot 2 can then be released from the toe-piece 1 and from the binding. Typically, it is during a user fall phase that this force Fd enable a switch to the release configuration. The boot can then be separated from the gliding board.

The lateral release mechanism appears in particular in FIGS. 5 and 6. This mechanism comprises a tie rod 146 having a drive surface 147 which cooperates with a shaft 134 carried by a wing 132 of the sole-clamp 13. On the example shown, the tie rod 146 has two drive surfaces 147 which each cooperate with a shaft 134 carried by one of the two wings 132. The displacement of the tie rod 146, along its main direction of extension, causes the displacement of the shaft 134, thereby causing the wing 132 to rotate about its axis of rotation Z133. Preferably, the main direction of extension of the tie rod 146 is coaxial with the median axis X121 of the body 12.

The release mechanism also comprises at least one first elastic mechanism 141 configured to return the tie rod 146 to a position whereby the tie rod 146 brings the wing 132 into the engagement configuration. In the example shown, the first elastic mechanism 141 tends to pull the tie rod 146 towards the front of the body 12, which tends to cause the shaft 134 to rotate about the axis of rotation Z133 so that the roller 135 of the wing 132 moves closer, in a horizontal plane, to the longitudinal axis X115 of the chassis 11. The roller 135 is then maintained in or returned to the engagement configuration. When the boot is engaged with the binding, the roller of the left wing presses against the left lateral surface of the front portion of the boot, and the roller of the right wing presses against the right lateral surface of the front portion of the boot.

For transmission of the force between the first elastic mechanism 141 and the tie rod 146, the body 12 can be provided to have a housing 123 for receiving at least a portion of the first elastic mechanism 141. The first elastic mechanism 141 has:

- a first end 1411 in support on the body 12, by direct contact or via an additional part such as a rocker 161, for example. In the example illustrated, the first end 1411 is in support on a wall 124 of the bottom of the housing 123 via a rocker 161 that will be described in detail later.
- a second end 1412 in support on the tie rod 146 or on a part affixed to the tie rod 146.

Preferably, the first elastic mechanism 141 is a spring working in compression, which may be a coil spring. The first elastic mechanism 141 compresses as the wings open or, in other words, as the rollers 135 of the wing 132 move away from the median axis X121 of the body 12 along a direction transverse to this axis median X121. This compression occurs along a working axis X142. This working axis X142 is preferably parallel to or merged with the median axis X121 of the body 12.

In the example illustrated, the tie rod 146 is affixed to a Sleeve 148 within which the first elastic mechanism 141 is housed at least partially. The sleeve 148 has a bottom wall 1481 on which the second end 1412 of the first elastic mechanism 141 takes support. Advantageously, an adjustment member 149 is provided to make it possible to vary the distance between the shafts 134 and the second end 1412 of the first elastic mechanism 141. This adjustment member 149 makes it possible to adjust the compression ratio of the first elastic mechanism 141 when the wings 132 are in the engagement configuration. Therefore, it makes it possible to adjust the force that the user must exert to space the wings apart and switch to the release configuration. Typically, the adjustment member 149 makes it possible to adjust the "DIN value" as has been defined above. The adjustment member 149 can be manipulated by the user by means of a tool. In the example shown, the adjustment member 149 has a recess for cooperation with a tool and can form a screw head.

In this example, as seen in FIGS. 6 to 8, the axis of rotation Y122 of the body 12 is positioned in the area of the upper portion of the body, above the first elastic mechanism 141 of the lateral release mechanism 14.

Vertical Retention Mechanism

As indicated above, to affix the boot 2 vertically to the gliding board, the boot is clamped between the support surface 131 of the sole-clamp 13, that is to say, the combination of the support surfaces of the wings, and the support plate 112 of the chassis 11. Thus, the sole-clamp 13 exerts a pressing force Fp on the boot 2 via the sole-clamp. The following paragraphs provide a detailed description of the kinematics that makes it possible to control this pressing force Fp, irrespective of the angle $\alpha$ that the body 12 forms in relation to the chassis 11. Subsequently, the position of the sole-clamp 13 in relation to the plate support 112 corresponds to the vertical position (along a Z axis) of the support surfaces 131 of the wings 132 of the sole-clamp 13 in relation to the horizontal surface tangent to the upper surface of the support plate 112. This position is directly related to the inclination $\alpha$ of the body 12 carrying the sole-clamp. The distancing of the sole-clamp 13 from the support plate 112 therefore corresponds to an increase in the vertical distance H, projection on a Z axis, between the support surfaces 131 and the support plate.

To this end, the toe-piece 1 comprises a vertical retention mechanism. This mechanism comprises at least one second elastic mechanism 151 configured to exert a return force Fr1 on the body 12. This return force Fr1 tends to return the support surfaces 131 of the wings 132 of the sole-clamp 13 towards the gliding board 3, more precisely towards the support plate 112 resting on the gliding board 3. In more detail, the return force Fr1 is exerted along a substantially vertical direction that makes it possible to generate a torque M on the body 12 about its axis of rotation Y122. This torque generates the pressing force Fp on the shoe 2 in the area of the support surface 131 of the sole-clamp 13.

Figure 9A:
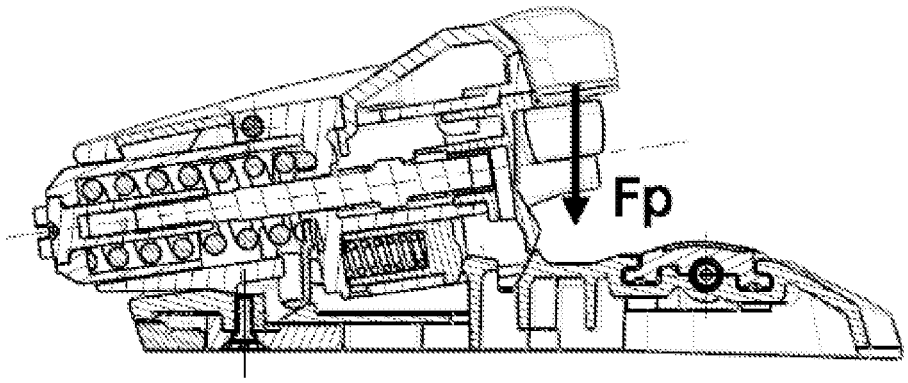
FIG. 9A is a graph illustrating the pressing force as a function of the inclination angle of the body in relation to the chassis for a plurality of adjustment values of the lateral release threshold.
Figure 9A:
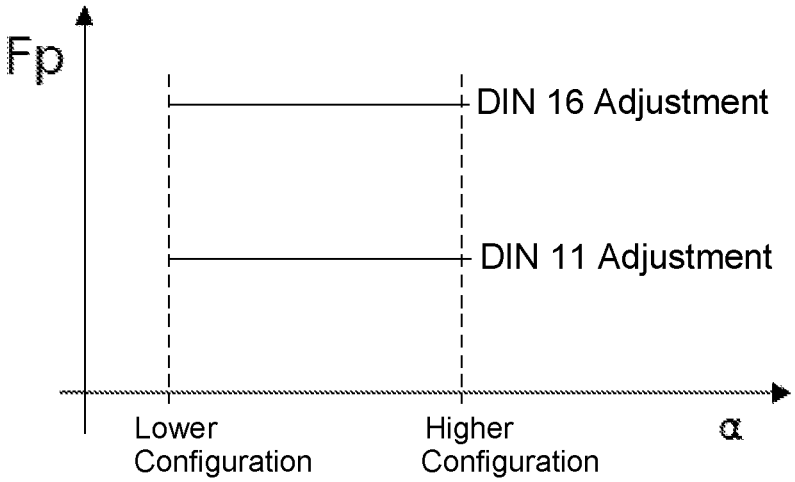
Figure 9B:
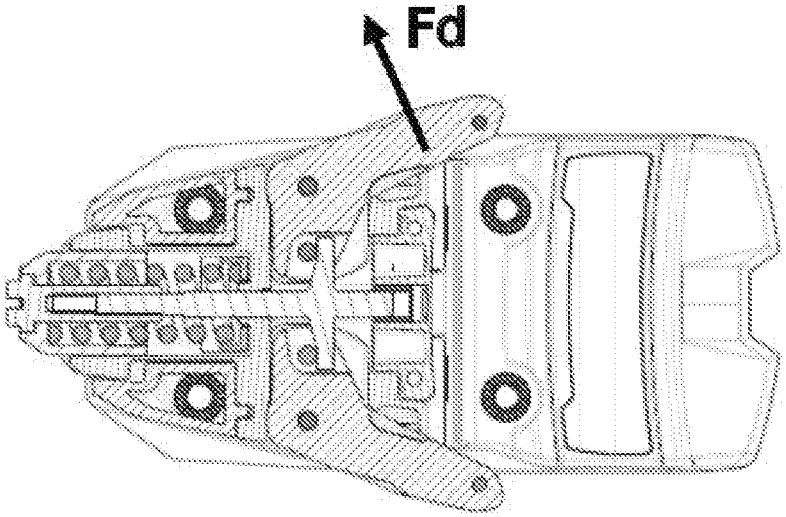
FIG. 9B is a graph illustrating the lateral release force as a function of the inclination angle of the body in relation to the chassis for a plurality of adjustment values of the lateral release threshold.
Figure 9B:
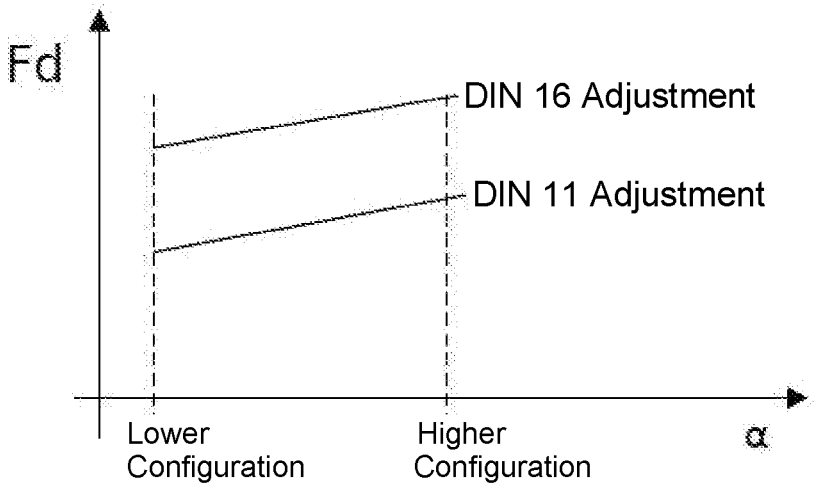
Figure 10:
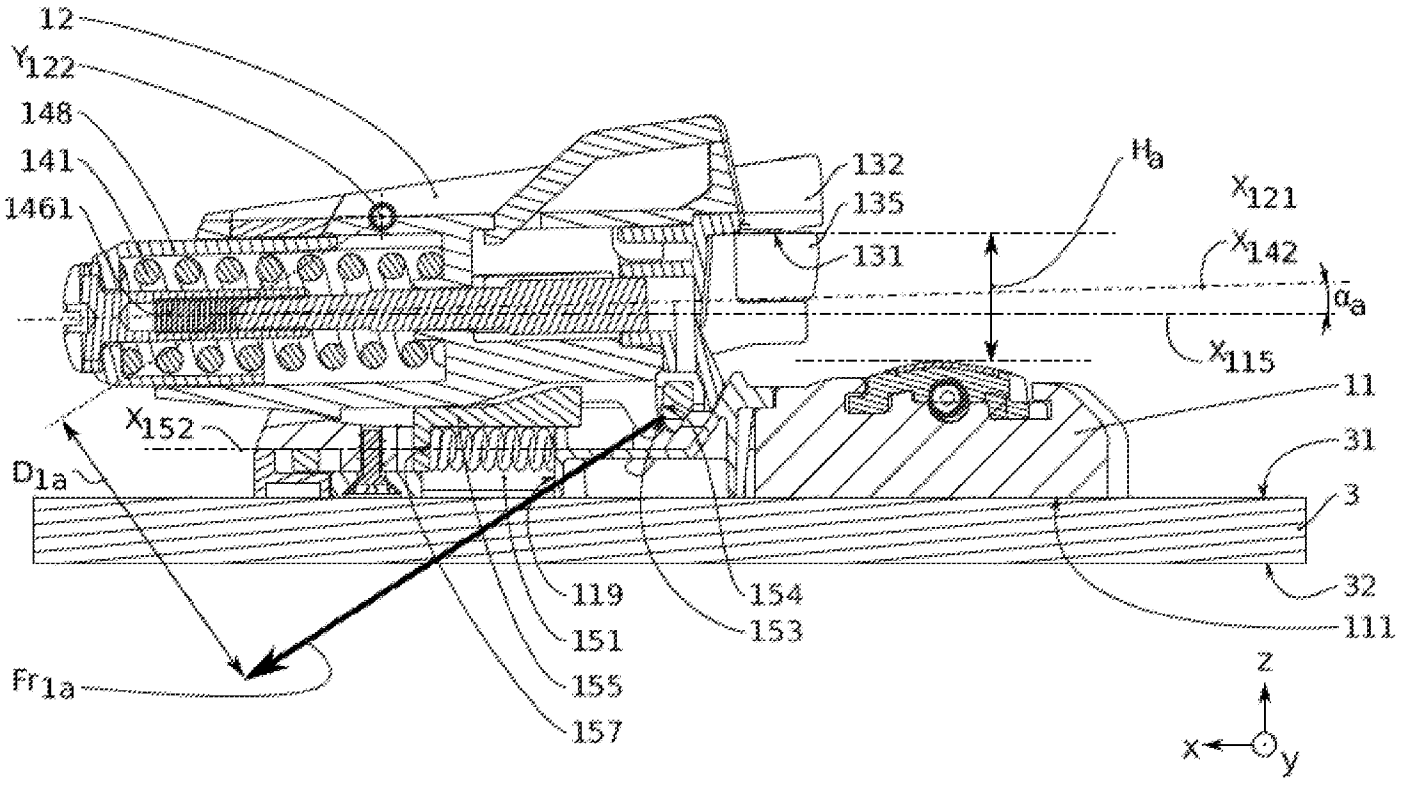
FIG. 10 is a view of a toe-piece according to another embodiment, in vertical cross-section and passing through a median axis of the toe-piece. The toe-piece is shown in a lower position, that is to say in a position in which it is biased by a first boot category.

The second elastic mechanism 151 can be carried either by the body 12, as is the case in the embodiment of FIGS. 1 to 9, or by the chassis 11, as is the case in the embodiment illustrated in FIG. 10. In these two embodiments, the second elastic mechanism 151 is configured so that the chassis 11 generates a return force Fr1 on the body 12.

In the example illustrated in FIG. 7, the median axis X121 of the body 12 is inclined by an angle $\alpha a$ in relation to the longitudinal axis X115 of the chassis 11 and the return force is referenced as Fr1*a*. The product of the intensity of the force Fr1*a* multiplied by the distance D1*a* between the direction of the force Fr1*a* and the axis of rotation Y122 is equal to the value of the torque Ma generated by the force Fr1*a* on the body 12. Thus, $Ma=Fr1a \times D1a$. In the absence of compensation means, described below, the intensity of the pressing force Fpa exerted by the sole-clamp 13 on the boot 2 is equal to this torque Ma divided by the distance Dp between the direction of the pressing force Fpa and the axis of rotation Y122. Thus, $Fpa=Ma/Dp=Fr1a/(D1a \times Dp)$.

FIG. 7 illustrates the references Fr1*a*, D1*a*, Ma, Fpa, Dp.

The second elastic mechanism 151 is configured so that the intensity of the return force Fr1 resulting from the action of the second elastic mechanism increases when the sole-clamp 13 moves away from the support plate 112. Preferably, the second elastic mechanism 151 is a spring working in compression, which may be a coil spring. It compresses as the sole-clamp 13 moves away from the support plate 112. This compression occurs along a working axis X152. According to one example, this working axis X152 is parallel to the median axis X121 of the body 12. Preferably, this working axis X152 is parallel but not coaxial with the working axis X142 of the first elastic mechanism 141. These two axes are included, for example, in the same vertical plane ZX.

In the non-limiting example illustrated in FIGS. 1 to 9, the body has a housing 127 shaped to receive a part, acting as a piston 155, capable of translating in the housing 127. This piston has a head 158 and a body 156. The body forms a sleeve 156, open at one of its ends and having an inner support wall 157 at the other one of its ends. The second elastic mechanism 151 is partially housed within the sleeve 156. A first end 1511 of the second elastic mechanism 151 is in support on a wall 128 of a housing 127 carried by the body 12. A second end 1512 of the second elastic mechanism 151 is in support on the support wall 157 of the piston 155. The force exerted by the compression of the second elastic mechanism 151 therefore tends to move the head 158 of the piston 155 away from the wall 128 of the body 12. The head 158 of the piston 155 has an outer surface intended to come into contact with an extension 116 of the chassis 11 or a part carried by the chassis.

The return force Fr1 resulting from the action of the second elastic mechanism 151, between the chassis 11 and the body 12, is applied in the area of the contact between the head 158 of the piston 155 and the extension 116.

Furthermore, the extension 116 and the head 158 of the piston 155 are configured such that, when the body 12 pivots about the axis of rotation Y122, the piston 155 is displaced in the housing 127 thus causing a variation in the compression of the second elastic mechanism 151. Consequently, the intensity of the return force Fr1 varies, as a function of the inclination of the body 12 in relation to the chassis 11. More precisely, in this case, when the body 12 pivots so as to increase the angle α, the extension 116 compresses the second elastic mechanism 151, thereby increasing the intensity of the return force Fr1 exerted by the chassis 11 on the body 12 via the piston 155.

Attenuation Device

According to a particular advantage, the toe-piece 1 comprises an attenuation device configured so as to reduce the increase in the intensity of the pressing force Fp1 caused by the sole-clamp 13 being moved away from the support plate 112.

Typically, the attenuation device makes it possible to limit the variation in the intensity of the pressing force Fp1 to a maximum of 20%, preferably to a maximum of 10%, and preferably to a maximum of 5% over the entire travel of the body 12 in relation to the chassis 11.

According to one embodiment, the variation in the intensity of the pressing force Fp1 varies in an interval between −20% and +10%, preferably in an interval between −15% and +5%.

According to an example of embodiment, the intensity of the pressing force Fp1 remains constant irrespective of the position of the body 12 in relation to the chassis 11, in this example irrespective of the value of the angle α formed between the median axis X121 of the body 12 and the longitudinal axis X115 of the chassis 11. For this example of embodiment, as the distance Dp between the point of application of the pressing force Fp of the sole-clamp 13 on the boot 2 and the axis of rotation Y122 of the body 12 is substantially constant, the intensity of the torque Ma, Mb is substantially constant irrespective of the position of the body 12 with respect to the chassis 11.

The angle α is dictated by the distance H, in projection along the vertical direction Z and in the engagement configuration, between the upper surface of the support plate 112 and the point of application of the pressing force Fp of the sole-clamp 13 on the boot 2. This distance is referenced as:

- H0 in FIG. 6 and corresponds to the configuration of the toe-piece in the absence of a boot;
- Ha in FIG. 7 and corresponds to the distance imposed by a boot of a first type, for example an alpine ski boot; and
- Hb in FIG. 8 and corresponds to the distance imposed by a boot of a second type, for example a ski touring boot.

In this example, the toe-piece is configured so that:

- When no boot is engaged with the toe-piece, the angle α is equal to 0°, and the clamping height corresponds to the reference height H0.
- When a boot of a first type, for example an alpine ski boot, is engaged with the toe-piece, the angle α is equal to 1.5°, and the clamping height Ha corresponds to the reference height H0+1.3 mm.
- When a boot of a second type, for example a ski touring boot, is engaged with the toe-piece, the angle α is equal to 5.5°, and the clamping height Hb corresponds to the reference height H0+5.7 mm.

Furthermore, the toe-piece comprises a stop device which makes it possible to limit the inclination of the body 12. Thus, in this example, the angle α is equal to a maximum of 8°, and the clamping height Hm corresponds to the reference height H0+8.2 mm.

The toe-piece is therefore designed such that the body 12 can tilt by a maximum angle α of 15°, preferably a maximum angle of 10°. In other words, the toe-piece is designed such that the body 12 can tilt so that the maximum clamping height Hm corresponds to the reference height H0+15 mm, preferably a maximum height corresponding to the reference height H0+10 mm.

Thus, irrespective of the dimensions of the boot portion 2, intended to be inserted into the toe-piece 1, the torque M as well as the pressing force Fp exerted by the sole-clamp 13 on this boot portion 2 remain constant or within a small interval. Thus, during a lateral release, the variation in the friction exerted by the sole-clamp 13 on the boot 2 also remains constant or within a small interval. The threshold value of the release force Fd necessary for switching to the release configuration therefore also remains constant or within a small interval regardless of these boot dimensions. User safety is therefore preserved regardless of the boots used with the same toe-piece 1.

To be able to reduce the increase in the intensity of the pressing force Fp1 caused by the sole-clamp 13 moving away from the support plate 112, the attenuation device is configured to modify the distance D1 between the direction of application of the return force Fr1 and the axis of rotation Y122 of the body 12. In this example, the distance D1 decreases at the same time as the return force Fr1 increases and the sole-clamp 13 moves away from the support plate 112.

To this end, the attenuation device comprises a cam, also referred to as a cam device, arranged on one of the parts enabling the transfer of the return force Fr1 from the chassis 11 to the body 12. This cam is shaped to vary the distance D1.

In the example illustrated in FIGS. 1 to 9, this cam is kinematically arranged between the second elastic mechanism 151 and the chassis 11. The cam can be arranged in other locations. For example, in an embodiment that will be described in detail with reference to FIG. 10, the cam can be arranged between the second elastic mechanism 151 and the body 12.

In the example illustrated in FIGS. 1 to 9, the cam device is formed by the cooperation of the extension 116 affixed to the chassis 11 and the outer surface of the piston 155. These parts 116, 155 are shaped such that the distance D1, as defined above, is reduced as the angle α formed by the inclination of the body 12 in relation to the chassis 11 increases. In this example, the outer surface of the head 158 of the piston 155 forms a first cam profile 153. Furthermore, the extension 116 forms a second cam profile 154 intended to cooperate with the first cam profile 153. Variants can naturally be envisioned. For example, one of the extension 116 and outer surface of the piston 155 could be provided to have a continuous surface and only the other one of the extension 116 and outer surface of the piston 155 to have a cam profile.

According to this embodiment, the cam therefore has a first cam profile 153 affixed to the body 12 in rotation about the axis of rotation Y122, and a second cam profile 154 affixed to the chassis 11.

The cam profiles 153, 154 are shaped such that the direction of the return force Fr1 approaches the axis of rotation Y122 as the distance H imposed by the boot 2 on the toe-piece 1 increases.

FIGS. 7 and 8 particularly clearly illustrate the operation of this attenuation device.

In FIG. 7, the boot 2 used imposes a distance Ha between the support plate 112 of the chassis 11 and the support surface 131 of the sole-clamp 13. As a result, the body 12 has an inclination aa in relation to the chassis 11. The chassis 11 exerts a return force Fr1*a* on the body 12, via the extension 116, due to the second elastic mechanism 151. The relative position of the first and second cam profiles 153, 154 of the cam device dictate the direction along which this return force Fr1*a* is exerted. This cam device therefore dictates the distance D1*a* between the direction of this return force Fr1*a* and the center of rotation Y122 of the body 12. Consequently, this cam device has an impact on the intensity of the pressing force Fpa exerted by the sole-clamp 13 on boot 21, because Fpa=Ma/Dp=Fr1*a*/(D1*a*×Dp), as indicated above.

In FIG. 8, the boot 2 used imposes a distance Hb, with Hb>Ha, between the support plate 112 of the chassis 11 and the support surface 131 of the sole-clamp 13. As a result, the body 12 has an inclination αb, with αb>αa, in relation to the chassis 11. The chassis 11 exerts a return force Fr1*b* on the body 12 by means of the extension 116, due to the second elastic mechanism 151. The relative position of the first and second cam profiles 153, 154 of the cam device dictates the direction along which this return force Fr1*b* is exerted. This cam device therefore dictates the distance D1*b* between the direction of this return force Fr1*b* and the center of rotation 122 of the body 12. As clearly appears in FIGS. 7 and 8, D1*b*<D1*a*. The intensity of the return force Fpb exerted by the sole-clamp 13 on the boot 2 is such that Fpb=Mb/Dp=Fr1*b*/(D1*b*×Dp).

The second elastic mechanism 151 and the cam device are configured such that the difference between D1*b* and D1*a*, on the one hand, and the difference between Fr1*b* and Fr1*a*, on the other hand, are such that the intensities of the return forces Fpb and Fpa are identical at approximately 20%, preferably at approximately 10%, preferably at approximately 5%. According to one embodiment, the intensities of the return forces Fpb and Fpa vary in an interval between −20% and +10%, preferably in an interval between −15% and +5%.

Compensation Mechanism

According to an optional but particularly advantageous exemplary embodiment, the toe-piece 1 comprises a compensation mechanism. This compensation mechanism is configured to adapt the pressing force Fp as a function of the adjustment made on the lateral release mechanism 14. More precisely, this compensation mechanism makes it possible to automatically increase the value of the pressing force Fp when the user adjusts the lateral release mechanism 14 to increase the lateral release threshold value.

Thus, according to one embodiment:

due to the attenuation device described above, for the same adjustment value of the lateral release threshold, typically the same DIN value, the pressing force Fp remains constant irrespective of the angle α, therefore irrespective of the dimension H of the boot 2. This scenario is illustrated in FIG. 9A: at constant DIN, Fp remains constant irrespective of the inclination of the body 12, irrespective of the value of the angle α;

due to the compensation mechanism, for two adjustment values of the lateral release threshold, typically for two DIN values, the pressing force Fp varies, for the same inclination of the body 12, i.e., for the same value of the angle α. This scenario is also shown in FIG. 9A: if the DIN value increases, then Fp increases. Indeed, when the user increases the DIN value, he may wish to have a firmer hold of his boot in the binding and seek to obtain more substantial threshold value of the release force Fd and pressing force Fp. In the absence of the compensation mechanism, an increase in the threshold value of the release force Fd, an increase desired by the user, is not accompanied by an increase in the pressing force Fp. The compensation mechanism makes it possible to overcome this drawback.

At the same time, as illustrated in FIG. 9B, the lateral release threshold value Fd increases slightly the more the body is inclined, that is to say, when the angle α increases, but the value of the DIN adjustment remains constant. Furthermore, the lateral release threshold value Fd increases significantly when the user increases the value of the DIN adjustment, in this example by going from a DIN 11 adjustment to a DIN 16 adjustment.

As illustrated in FIG. 8, the compensation mechanism exerts an additional return force Fr2*b* on the body 12, which generates a torque M2*b* on the body 12, about its axis of rotation Y122. The distance between the direction of this additional return force Fr2*b* and the axis of rotation Y122 is referenced as D2*b*. Thus, the torque M2*b* is equal to: M2*b*=Fr2*b*×D2*b*. Moreover, as seen above, the second elastic mechanism 151 also exerts a return force Fr1*b* on the body 12, which translates into a torque M1*b* equal to M1*b*=Fr1*b*×D1*b*. Thus, the torque exerted on the body is the sum of the two previous torques and is equal to: Mb=M1*b*+M2*b*. The pressing force Fpb is directly proportional to the torque Mb and is equal to: Frp=Mb/Dp. The value of the pressing force Fpb exerted by the sole-clamp 13 on the boot 2 is then deduced therefrom, which is equal to: Fpb=Fr1*b*/(D1*b*×Dp)+Fr2*b*/(D2*b*×Dp).

Figure 3:
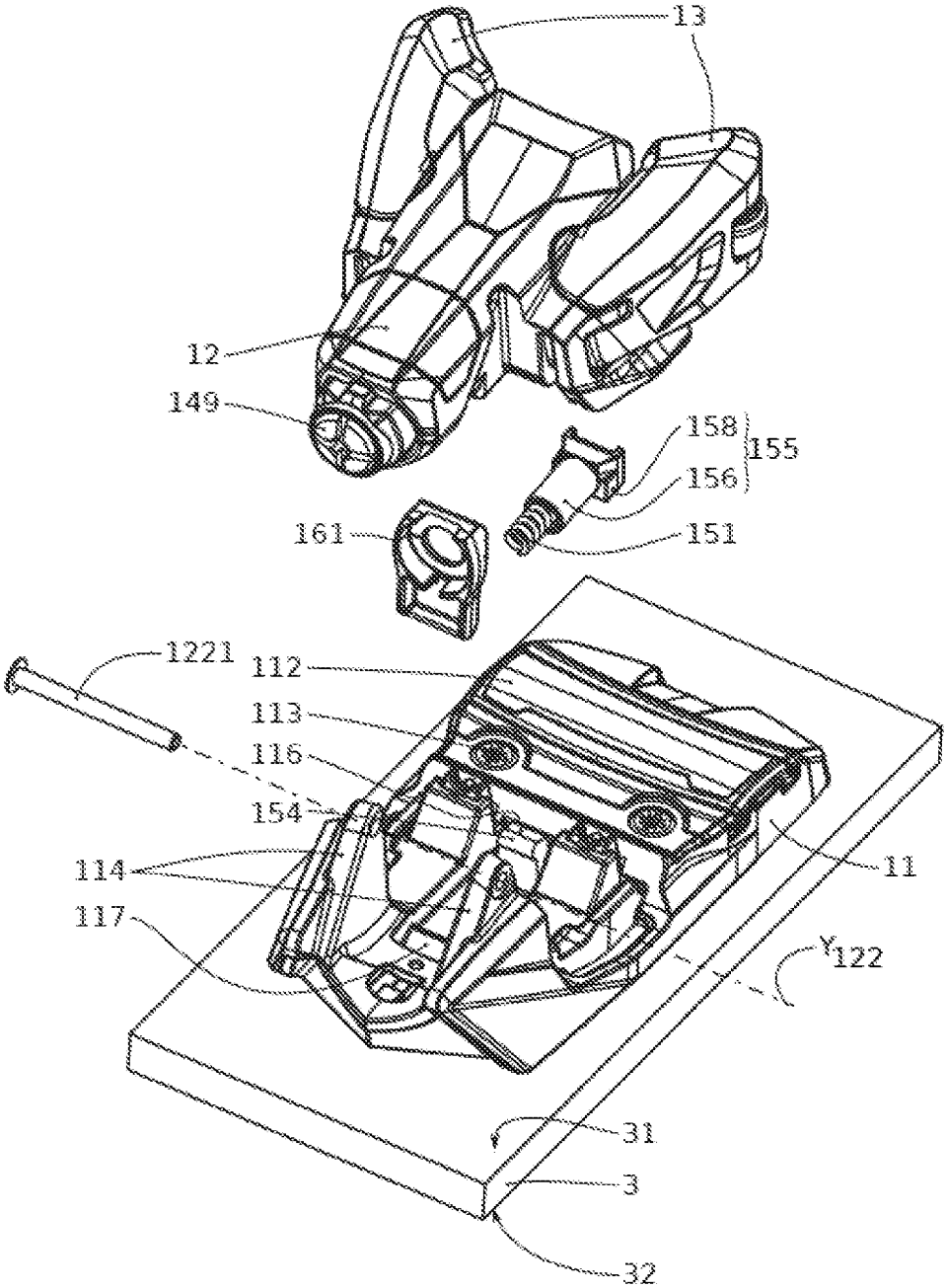
FIG. 3 is an exploded perspective view of the toe-piece illustrated in FIG. 1.
Figure 4:
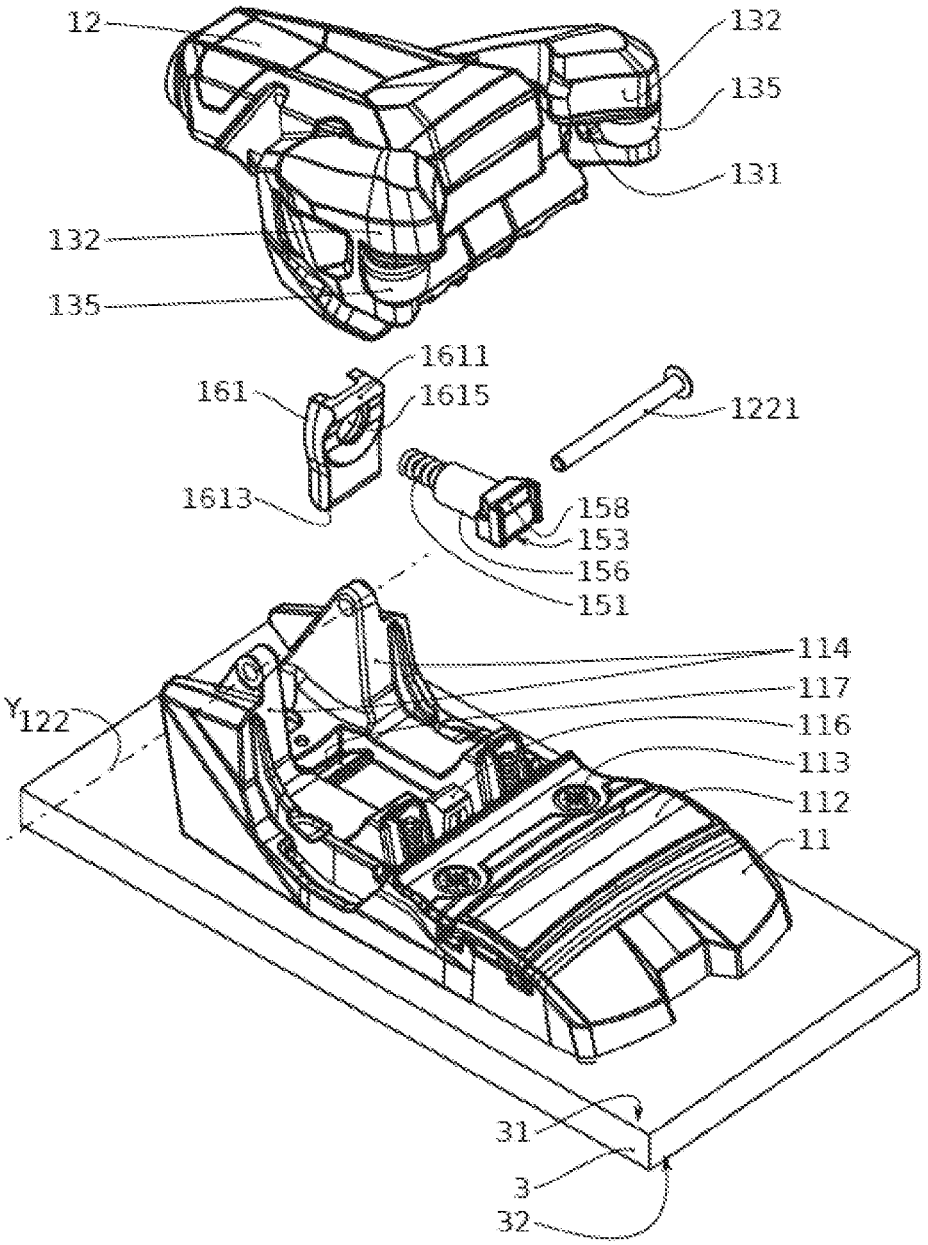
FIG. 4 is another exploded perspective view of the toe-piece illustrated in FIG. 1.

The compensation mechanism comprises a rocker 161 shown in perspective in FIGS. 3 and 4. This rocker 161 is configured to be partially housed in the housing 123 of the body 12 receiving the first elastic mechanism 141, The rocker 161 is configured to rotate within the body 12, about a direction substantially perpendicular to the working axis X142 of the first elastic mechanism 141. Typically, the rocker 161 is configured to rotate, over a small angular sector, about a direction transverse to the median axis X121 of the body 12. To this end, the rocker preferably comprises a pivot portion 1611 configured to be housed in a seat 125 formed in the wall 124 of the housing 123.

In this construction, as mentioned above, the rocker is inserted between the first end 1411 of the first elastic mechanism 141 and the body 12. The first elastic mechanism therefore takes support on the rocker. Thus, when the rocker is pivoted, the first elastic mechanism is acted upon, by compressing it, for example, when the rocker pivots in one direction.

The rocker 161 also comprises a support portion 1612 interposed between the second end 1412 of the first elastic mechanism 141 and the wall 124 of the bottom of the housing 123 of the body 12. Thus, the first elastic mechanism 141 takes support in particular on this support portion 1612.

Preferably, the pivot portion 1611 and the support portion 1612 are located on both sides of the working axis X142. To this end, the rocker 161 comprises an opening 1615 shaped to be crossed through by the tie rod 144.

The rocker 161 also comprises an extension 1616 extending beyond the body 12 to come into contact with a portion 117 of the chassis 11 or a part carried by the chassis.

At least either the rocker 161 or the portion 117 of the chassis has a cam profile. In the example shown, the extension 1616 carries a cam profile 1613 that cooperates with a profile 1614 having the general shape of a slope and carried by the portion 117 of the chassis.

As shown in FIG. 7, that is to say with a boot 2 that causes the body 12 to tilt in relation to the chassis 11 by a low angle $\alpha a$ ("low" boot 2), the cooperation between the cam surface 1613 and the profile 114 enables the support portion 1612 to be maintained in its seat 126, that is to say, in a position in which this support portion 1612 does not, or only slightly does, constrain the first elastic mechanism 141. In this example, with the angle $\alpha a$, the cam profile 1613 maintains the support portion 1612 pressed in a seat 126 formed in the wall 124 of the body 12. The rocker 161 does not compress the first elastic mechanism 141.

Conversely, as illustrated in FIG. 8, that is to say with a shoe 2 which causes the body 12 to tilt in relation to the chassis 11 by a high angle $\alpha b$ ("high" boot 2), the cooperation between the cam surface 1613 and of the profile 114 causes the support portion 1612 to move away from its seat 126. This translates into in the compression of the first elastic mechanism 141. This results in a return force Fr2*b* which, with the return force Fr1*b*, contributes to generating a torque Mb on the body 12, about its axis of rotation Y122. This torque Mb exerts the pressing force Fpb of the sole-clamp 13 on the boot 2. Moreover, as the first elastic mechanism 141 is more strongly compressed, the threshold value of the release force Fd increases, as illustrated in FIG. 9B.

Thus, FIGS. 7 and 8 illustrate the contribution of the return force Fr2 exerted by the compensation mechanism on the pressing force Fp. These figures also clearly illustrate the compression imposed by this compensation mechanism on the first elastic mechanism 141, and therefore on the threshold value of the release force Fd (typically the DIN value).

As indicated above, this compensation mechanism is optional, and the toe-piece is fully operational without such a mechanism.

Alternative Embodiment

An alternative embodiment will now be described with reference to FIGS. 10 and 11. With the exception of the details are be provided below, all the characteristics, advantages and technical effects mentioned above with respect to the embodiment of FIGS. 1 to 9 are fully transposable to and combinable with the embodiment described with reference to FIGS. 10 and 11.

Figure 11:
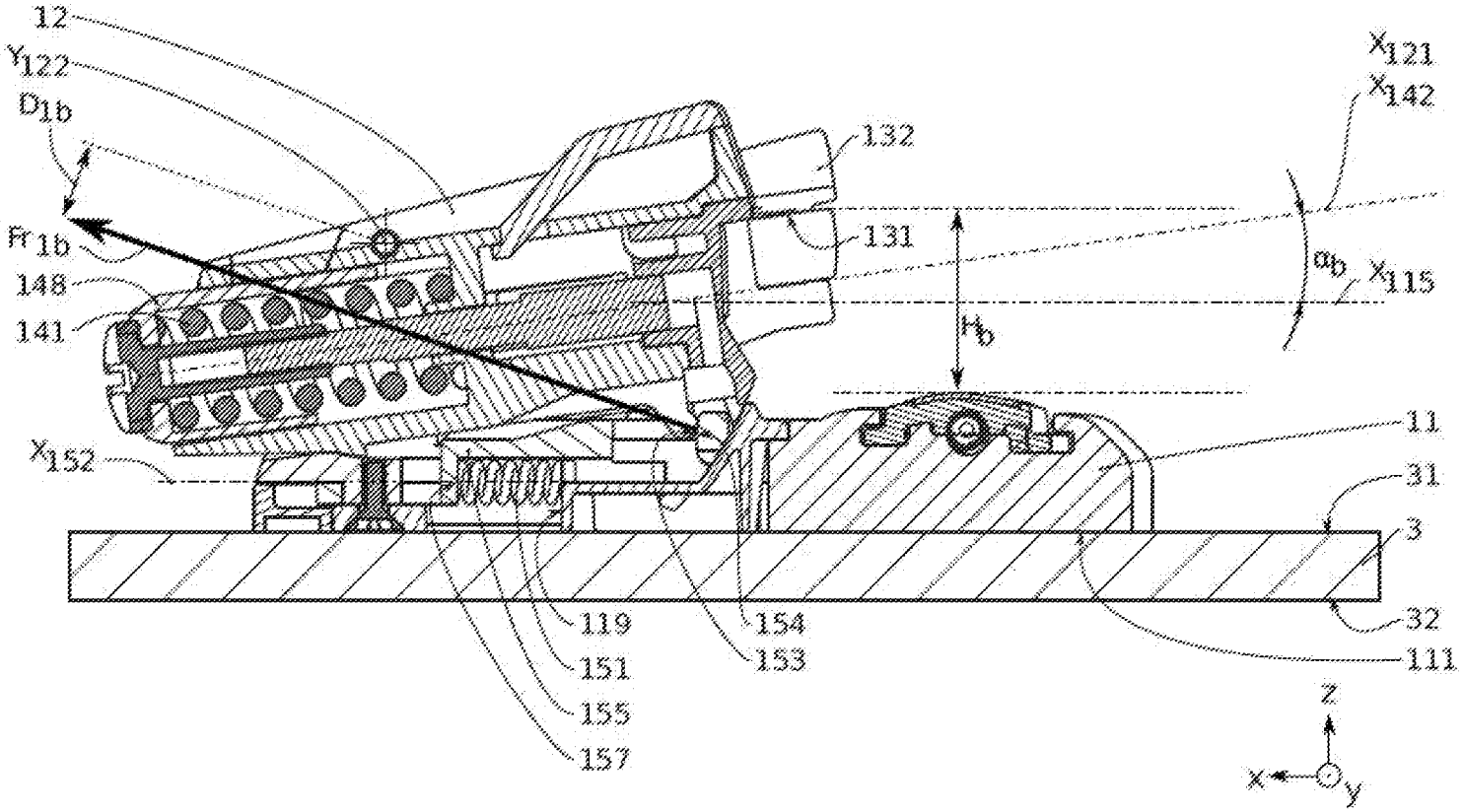
FIG. 11 is a view identical to that of FIG. 10, but in which the toe-piece is in the upper position, that is to say in a position in which it is biased by a second hoot category.

The hatching used for FIGS. 10 and 11 may vary without implying structural differences. Furthermore, in FIG. 10, a thread 1461 is shown on a portion of the tie rod 146, this thread 1461 cooperating with the adjustment member 149 described with reference to the embodiment illustrated in FIGS. 1 to 9.

In this embodiment, the second elastic mechanism 151 is carried by the chassis 11, unlike the first embodiment in which the second elastic mechanism 151 is carried by the body 12. More precisely, this first elastic mechanism has one end in support on a support wall 119 affixed to the chassis 11, and another end in support on a support wall 157 carried by a piston 155 slidably translationally mounted on the chassis 11. This translation occurs along an axis parallel to the longitudinal axis X115 of the chassis 11. Thus, the body 12 is in rotation in relation to the second elastic mechanism 151.

The piston 155 has a surface 154 sliding in relation to the chassis 11 and in relation to the axis of rotation Y122 of the body 12. The body 12 has a surface 153 shaped to remain in contact with the surface 154. The return force Fr1*a* exerted by the second elastic mechanism 151 is applied to the body 12 in the area of the contact between the surfaces 153 and 154. Thus, these surfaces 153, 154 are kinematically inserted between the second elastic mechanism 151 and the body 12.

FIG. 10 illustrates the toe-piece in the lower position, that is to say in a position in which it is biased by a first boot category. The median axis X121 of the body is therefore inclined in relation to the longitudinal axis X115 of the chassis 11 by a non-zero inclination angle $\alpha a$.

FIG. 11 illustrates the toe-piece in the upper position, that is to say in a position in which it is biased by a second boot category. The median axis X121 of the body is therefore inclined in relation to the longitudinal axis X115 of the chassis 11 by a non-zero inclination angle $\alpha b$.

According to this alternative embodiment, the cam has a first cam profile 153 affixed to the body 12, and a second cam profile 154 carried by the chassis 11 and preferably being slidably mounted on the chassis 11.

These surfaces 153 and 154 are configured to form the cam device of the attenuation device described above. At least one of these surfaces 153, 154 has a cam profile such that an increase in the inclination of the body 12 in relation to the chassis 11 (so as to move the sole-clamp 13 away from the support plate 112), causes:

- a greater compression of the second elastic mechanism 151, and
- a variation in the direction of application of the return force Fr1*a*, Fr1*b* exerted on the body 12, due to the second elastic mechanism 151, by means of the cooperation between the surfaces 153 and 154, this variation in direction tending to reduce the distance D1 (D1*b*<D1*a*) between this direction and the axis of rotation Y122 of the body 12.

Thus, for this embodiment, as for that described with reference to FIGS. 1 to 9, the attenuation device makes it possible to limit, or even cancel the variation in the intensity of the pressing force Fp when the body 12 tilts in relation to the chassis 11. Without an attenuation device according to the invention, the intensity of the pressing force Fp tends to vary proportionally as a function of the inclination of the body in relation to the chassis. Consequently, the attenuation device makes it possible to control the pressing force Fp according to the inclination of the body and, in particular, to avoid having a substantial pressing force Fp at the end of the body travel.

With the configurations of the non-limiting examples described above, it is noted that the second elastic mechanism 151 is arranged so as to act on the body 12, that is to say to exert a return force Fr1 thereon, irrespective of the position of the sole-clamp 13 in relation to the body 12. Furthermore, it is noted that the second elastic mechanism 151 acts on the body 12 independently of the action exerted by the sole-clamp 13 on the first elastic mechanism. Thus, the first elastic mechanism and the second elastic mechanism act completely independently.

Examples of Possible Variants

The invention is not limited to the embodiments described above but extends to all of the embodiments covered by the claims.

The invention also applies to constructions combining some or all of the features characterizing the embodiments described above.

According to a variant, the first elastic mechanism extends transversely, along a direction Y.

For example, although, in the detailed description and the drawing figures, the retaining device incorporating the cam is a binding toe-piece, the invention also extends to a heel-piece, also referred to as the binding heel-piece.

Furthermore, although, in the detailed description, the movability of the body 12 in relation to the chassis 11 is a rotational movability about the axis of rotation 122, the invention also extends to a configuration in which the body 12 is movable translationally in relation to the chassis 11 or is movable according to a combination of rotational and translational movement in relation to the chassis 11.

In the above description, the non-limiting examples may relate to a gliding board forming a ski and a ski boot. The invention extends to gliding boards other than skis, for example snowboards and footwear suitable for snowboards.

Furthermore, in the preceding example, the retaining device, also referred to as the sole-clamp 13, comprises two wings 132 pivotally mounted on the body, each pivoting about a respective axis of rotation. Nevertheless, the two wings can be provided to be affixed rotationally. For example, they can form a generally U-shaped or V-shaped unitary element mounted rotationally about a single axis on the body 12.

Moreover, in the above example, the vertical retention mechanism comprises a single second elastic mechanism. Nevertheless, this vertical retention mechanism can be provided to comprise two or more second elastic mechanism. For example, two springs arranged on both sides of the median axis X121 of the body 12, and each cooperating with a cam profile, can be provided.

Further, at least because the various embodiments of the invention are disclosed herein in a manner that enables one to make and use them as described and shown, such as for simplicity or efficiency, for example, the invention can be practiced in the absence of any additional element or additional structure that is not specifically disclosed herein.

The invention claimed is:

1. Toe-piece for binding a boot on a gliding board comprising:

a chassis having a lower surface configured to be affixed to the gliding board;

a body movably mounted on the chassis;

a sole-clamp movably mounted on the body and capable of coming into contact with an upper surface and at least one lateral portion of a front or rear portion of the boot, when the boot is engaged with the toe-piece;

a lateral release mechanism comprising at least one first elastic mechanism acting on the sole-clamp to return the sole-clamp to a configuration of engagement with the boot;

a vertical retention mechanism comprising a second elastic mechanism, distinct from the first elastic mechanism, arranged so as to always exert a return force on the body in order to bring the sole-clamp back toward the lower surface of the chassis, the return force producing a force pressing the sole-clamp on the boot when the boot is engaged with the binding;

at least one cam kinematically inserted between the second elastic mechanism and either the chassis or the body;

the cam having a shape configured to modify, depending on a position of the body in relation to the chassis, a direction of the return force exerted by the second elastic mechanism on the body so as to attenuate a variation in the pressing force when the sole-clamp is moved away from the lower surface of the chassis.

2. Toe-piece according to claim 1, wherein:

the body is pivotally mounted on the chassis about an axis of rotation crosswise to a longitudinal axis of the chassis;

the cam has a shape configured to modify the direction of the return force exerted by the second elastic mechanism on the body so that a distance between the direction of the return force and the axis of rotation of the body differs as a function of the angle of inclination of the body in relation to the chassis.

3. Toe-piece according to claim 2, wherein:

the axis of rotation of the body is positioned in an area of the upper portion of the body, above the first elastic mechanism of the lateral release mechanism.

4. Toe-piece according to claim 1, wherein:

the second elastic mechanism is carried by the body.

5. Toe-piece according to claim 1, wherein:

the cam and the vertical retention mechanism have shapes configured so that the pressing force does not vary by more than 20%, regardless of the position of the sole-clamp in relation to the body.

6. Toe-piece according to claim 1, wherein:

the cam and the vertical retention mechanism have shapes configured so that the pressing force does not vary by more than 10%, regardless of the position of the sole-clamp in relation to the body.

7. Toe-piece according to claim 1, wherein:

the second elastic mechanism is arranged so as to act always on the body, regardless of the position of the sole-clamp in relation to the body.

8. Toe-piece according to claim 1, wherein:

the second elastic mechanism is arranged so as to act on the body independently of the action of the sole-clamp on the first elastic mechanism of the lateral release mechanism.

9. Toe-piece according to claim 1, wherein:

the first elastic mechanism is configured to be alternately compressed and relaxed along a first working axis;

the second elastic mechanism is configured to be alternately compressed and relaxed along a second working axis, said second working axis being misaligned with respect to said first working axis.

10. Toe-piece according to claim 1, wherein:

a first profile of the cam is translationally mounted on the body.

11. Toe-piece according to claim 10, wherein:

the second elastic mechanism acts directly on a piston capable of translating in a housing of the body, a portion of the piston forming a first profile of the cam.

12. Toe-piece according to claim 1, wherein:

the sole-clamp comprises two wings, each wing being pivotally mounted on the body.

13. Toe-piece according to claim 1, wherein:

the cam is dimensioned such that the return torque exerted on the body, and wherein by the product of the intensity of the return force multiplied by the distance between the direction of the return force and the axis of rotation of the body, is, when the at least one sole-clamp is away from the gliding board, identical, at approximately 20% to this return torque when the sole-clamp is close to the lower surface of the chassis.

14. Toe-piece according to claim 1, wherein:

the cam is dimensioned such that the return torque exerted on the body, and wherein by the product of the intensity of the return force multiplied by the distance between the direction of the return force and the axis of rotation of the body, is, when the at least one sole-clamp is away from the gliding board, identical, at approximately 10% to this return torque when the sole-clamp is close to the lower surface of the chassis.

15. Toe-piece according to claim 1, wherein:

the lateral release mechanism comprises an adjustment device configured to enable adjustment of a threshold value of a release force to be applied to the lateral release mechanism to cause the sole-clamp to switch to a lateral release configuration, the toe-piece also comprising a compensation mechanism configured to exert an additional return force on the body, the intensity of the additional return force being a function of said adjustment, the pressing force being a function of the return force exerted by the second elastic mechanism and of the additional return force exerted by the compensation, mechanism.

16. Gliding hoard in combination with at least one toe-piece according to claim 1.

17. Toe piece for binding a boot on a gliding hoard comprising:

a chassis having a lower surface configured to be affixed to the gliding board;

a body movably mounted on the chassis;

a sole-clamp movably mounted on the body and capable of coming into contact with art upper surface and at least one lateral portion of a front or rear portion of the boot, when the boot is engaged with the toe-piece;

a lateral release mechanism comprising at least one first elastic mechanism acting on the sole-clamp to return the sole-clamp to a configuration of engagement with the boot;

a vertical retention mechanism comprising a second elastic mechanism, distinct from the first elastic mechanism, arranged so as to continuously exert a return force on the body in order to bring the sole-clamp back toward the lower surface of the chassis, the return force producing a force pressing the sole-clamp on the hoot when the boot is engaged with the binding;

at least one cam kinematically inserted between the second elastic mechanism and either the chassis or the body;

the cam having a shape configured to modify, depending on a position of the body in relation to the chassis, a direction of the return force exerted by the second elastic mechanism on the body so as to attenuate a variation in the pressing force when the sole-clamp is moved away from the lower surface of the chassis wherein:

the body is pivotally mounted on the chassis about an axis of rotation crosswise to a longitudinal axis of the chassis;

the cam has a shape configured to modify the direction of the return force exerted by the second elastic mechanism on the body so that a distance between the direction of the return force and the axis of rotation of the body differs as a function of the angle of inclination of the body in relation to the chassis;

and wherein:

the axis of rotation of the body is positioned in an area of the upper portion of the body, above the first elastic mechanism of the lateral release mechanism.

* * * * *